US006088877A

United States Patent [19]

Swy et al.

[11] Patent Number: 6,088,877

[45] Date of Patent: Jul. 18, 2000

[54] GLIDE ATTACHMENT PLATE FOR FURNITURE LEG

[75] Inventors: Philip P. Swy, Temperance; William F. Lohness, Jonesville, both of Mich.

[73] Assignee: Michigan Tube Swagers & Fabricators, Inc., Temperance, Mich.

[21] Appl. No.: 09/233,972

[22] Filed: Jan. 20, 1999

[51] Int. Cl.[7] ..... A47B 33/00

[52] U.S. Cl. ..... 16/42 T; 16/42 R; 248/188.9

[58] Field of Search ..... 16/42 T, 42 R; 248/188.9

[56] References Cited

U.S. PATENT DOCUMENTS

| | | | |
|---|---|---|---|
| 2,618,009 | 11/1952 | Tinnerman | 16/42 R |
| 2,666,943 | 1/1954 | Kramcsak, Jr. | 16/42 R |
| 2,757,407 | 8/1956 | Kramcsak, Jr. | 16/42 R |
| 3,701,450 | 10/1972 | Belzberg | 16/42 T |
| 3,742,552 | 7/1973 | Balchunas | 16/42 R |
| 3,989,212 | 11/1976 | Jennings | 248/188.9 |
| 4,718,631 | 1/1988 | Reynolds et al. | 248/615 |
| 4,876,782 | 10/1989 | Carpinella et al. | 29/234 |
| 5,042,764 | 8/1991 | Carpinella et al. | 248/188.2 |
| 5,170,972 | 12/1992 | Casals Guell | 248/188.9 |
| 5,287,595 | 2/1994 | Stevens, Jr. | 16/42 T |
| 5,533,457 | 7/1996 | Cox | 100/150 |

FOREIGN PATENT DOCUMENTS

| | | | |
|---|---|---|---|
| 553103 | 2/1958 | Canada | 16/42 T |

*Primary Examiner*—Chuck Y. Mah

*Attorney, Agent, or Firm*—Gifford, Krass, Groh, Sprinkle, Anderson & Citkowski, P.C.

[57] ABSTRACT

A glide attachment plate for supporting a glide with respect to the end of a furniture leg has a perimeter portion and an interior portion. The perimeter portion extends inboard from the exterior edge of the attachment plate to an interior edge which is spaced from the exterior edge by a short distance. The perimeter portion has a shape corresponding to the solid portion of a cross section of a hollow tube forming the furniture leg. The interior portion of the attachment plate extends inboard from the interior edge of the perimeter portion. Multiple tabs project upwardly from the interior portion. These tabs each have a gripping face which is directed toward the perimeter portion. The gripping faces are vertically aligned with the interior edge of the perimeter portion and are configured to engage the inner wall of the hollow tube forming the furniture leg.

14 Claims, 3 Drawing Sheets

FIG-4
PRIOR ART
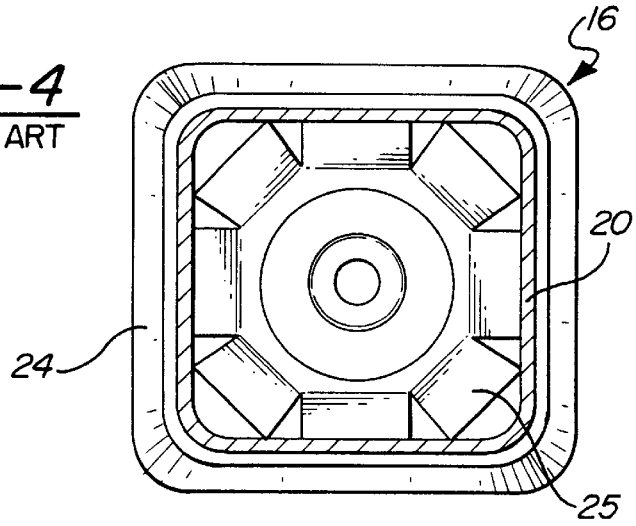
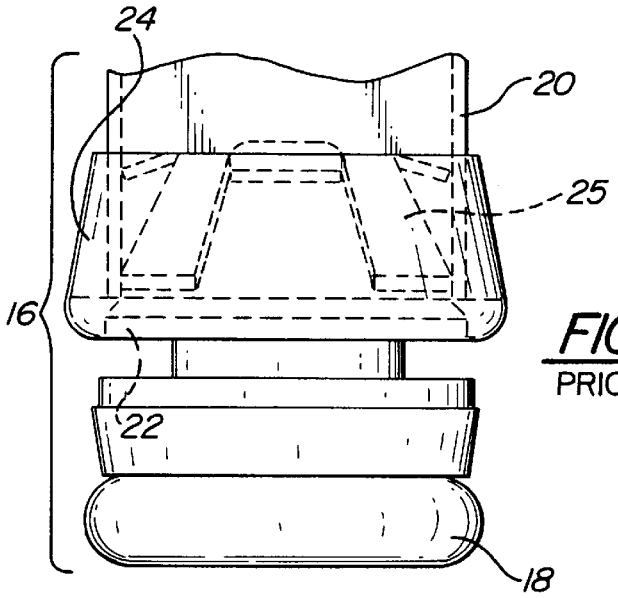
FIG-5
PRIOR ART
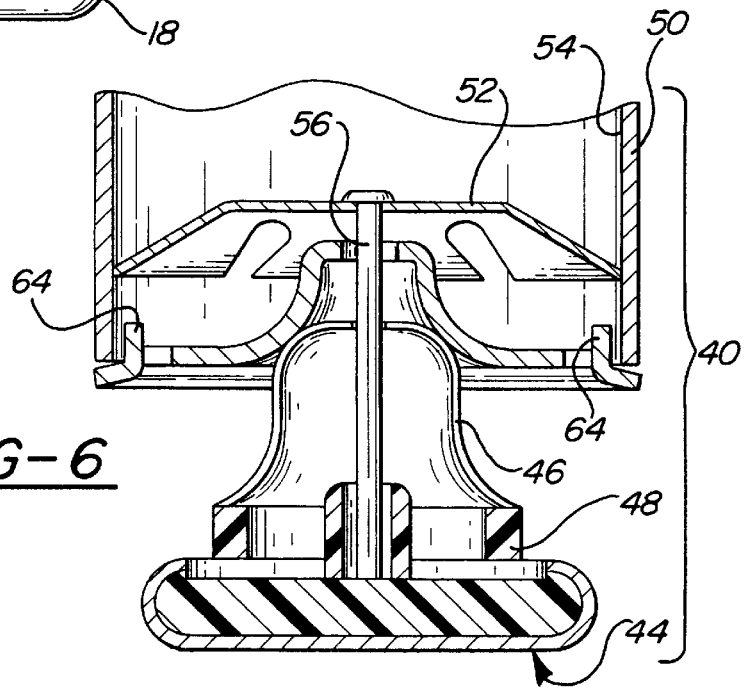
FIG-6

42
66
66
64
68
64
68
8
8
68
64
68
58
64
62
56
68
68
60
64
64

42
66
62
64
64
56
66
D 70
72

GLIDE ATTACHMENT PLATE FOR FURNITURE LEG

FIELD OF THE INVENTION

The present invention relates generally to attachments for connecting a glide to the end of a hollow furniture leg and, more specifically, to an attachment plate that avoids the need for an externally visible support collar.

BACKGROUND OF THE INVENTION

Chairs and other types of furniture with legs require some type of termination on the legs to prevent the ends of the legs from becoming embedded in the surface on which they are placed and to allow the chair or piece of furniture to be moved more easily. Typically, furniture legs may be terminated either by finishing the end of the leg to give a smooth surface, by attaching a foot or glide, or by attaching a roller or a wheel to the bottom of the leg. Some furniture legs are solid, such as solid wood, and may be finished so as to give a smooth end, or some type of foot or glide may be attached to the solid leg. Other types of furniture, especially office furniture, have legs formed of hollow metal tubing. These legs are typically terminated by attaching some type of foot or glide to the bottom of the leg.

As shown in FIG. 1, a typical chair 10 will have four legs 12 each terminating in a glide 14. Several attachment approaches have been developed for attaching glides 14 to the bottom of chair legs 12. It is desirable for the attachment interconnecting the glide 14 with the chair leg 12 to securely attach the glide 14 to the chair leg 12 and to resist twisting forces and shearing (side to side) forces. It is also desirable that the attachment be easily assembled onto or into the chair leg 12, and that the attachment be inexpensive and durable.

One type of attachment for attaching a glide to a chair leg is shown in U.S. Pat. No. 5,287,595 to Stevens Jr. This patent shows a combination glide and pintle which is formed as a unitary piece from plastic. The pintle portion is inserted into a chair leg thereby retaining the glide portion to the chair leg. A drawback to this combination device is that the plastic may not provide sufficient strength for some applications. Also, the pintle portion may be unable to develop sufficient grip to securely retain the glide in the chair leg.

Referring now to FIGS. 4 and 5, another prior art attachment approach is shown. In these figures, a glide assembly 16 is attached to a chair leg 20 which is a hollow metal tube with a generally square cross section. The glide assembly 16 includes a glide base 18 which is designed to contact a floor. The glide base 18 is interconnected with the chair leg 20 by an attachment plate 22 and support collar 24. The attachment plate 22 rests against the bottom of the chair leg 20 and the support collar 24 surrounds the attachment plate 22 and the bottom of the chair leg 20. The attachment plate 22 resists upward forces on the glide base 18 so that the glide base 18 is not forced up into the chair leg 20. The support collar 24 grips the outside of the chair leg 20 and resists shearing and twisting forces. The attachment plate 22 is typically made out of metal and the support collar 24 may be made out of metal or plastic. The glide assembly 16 is held into the chair leg 20 by a clip 25 which is typically made from spring steel. A major drawback to the glide assembly 16 shown in FIGS. 4 and 5 is aesthetics. Some purchasers feel that this type of glide assembly is cheap looking because of the visible support collar 24. These purchasers typically request a glide assembly that eliminates the support collar 24. However, the support collar 24 may not be eliminated from the glide assembly 16 shown in FIGS. 4 and 5 because the support collar 24 serves the important purpose of resisting twisting and shear forces. Elimination of the support collar 24 would allow the attachment plate 22 to move and twist thereby hurting the performance of the glide assembly 16.

To overcome the limitations of the glide assembly 16, shown in FIGS. 4 and 5, a collarless glide assembly 26 was developed, as shown in FIGS. 2 and 3. In this variation, the attachment plate 28 is designed with a raised interior portion 30 which acts to help keep the attachment plate 28 centered in the chair leg 32. Like in the previous version, the glide assembly 26 is held in the chair leg 32 by a spring steel clip 34. While this type of glide assembly avoids the need for a support collar, it has proven less than satisfactory when it comes to resisting shearing and twisting forces. The attachment plate 28 with the raised interior portion 30 does not solidly locate the glide assembly 26 into the bottom of the chair leg 32.

There remains a need for a collarless glide assembly that resists shear and twisting forces, is easy to install, durable, and inexpensive.

SUMMARY OF THE INVENTION

According to the present invention, shortcomings of the prior art are overcome by an improved glide attachment plate which is inexpensive but solidly locates a glide assembly with respect to the bottom of a hollow chair leg. The improved glide attachment plate includes a perimeter portion which extends inboard from the exterior edge of the attachment plate to an interior edge which is spaced from the exterior edge by a short distance. A perimeter portion has a shape which corresponds to the solid portion of the cross section of the hollow tube which forms a furniture leg. The attachment plate also includes an interior portion which extends inboard from the interior edge of the perimeter portion of the attachment plate. A plurality of tabs project upwardly from the interior portion of the attachment plate. Each of the tabs has a gripping face which is directed toward the perimeter portion of the attachment plate. Th gripping face is vertically aligned with the interior edge of the perimeter portion such that the tabs are configured to engage the inner wall of the hollow tube fog the furniture leg.

In some embodiments, the tabs are upwardly bent portions of interior portion of the attachment plate. In other embodiments, the perimeter portion of the attachment plate resides in the first plane and at least part of th interior portion resides in a second plane which is separated from the first plane. The glide attachment plates are available in different shapes and sizes to suit a variety of furniture leg types.

BRIEF DESCRIPTION OF THE DRAWINGS

FIG. 4 is a top view of a prior art glide assembly with collar;

FIG. 5 is a side elevational view of the glide assembly of FIG. 4 installed on a chair leg;

FIG. 6 is a cutaway side elevational view of a glide assembly including an improved glide attachment plate according to the present invention;

DETAILED DESCRIPTION OF THE PREFERRED EMBODIMENTS

Figure 1:
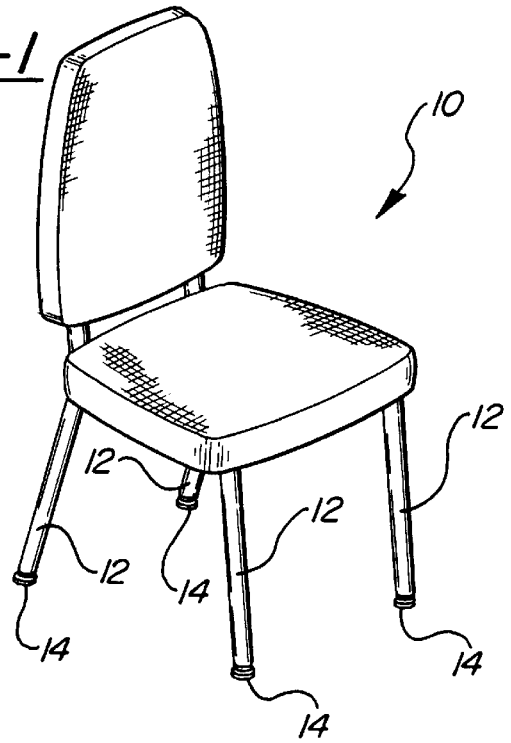
FIG. 1 is a perspective view of a chair.
Figure 2:
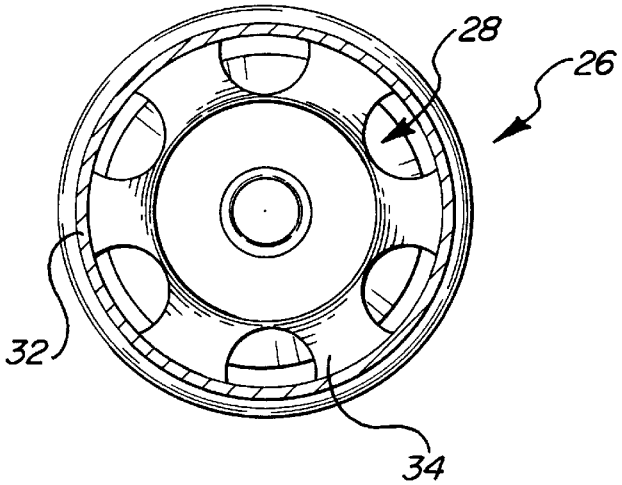
FIG-2 PRIOR ART
FIG. 2 is a top view of one type of prior art collarless glide assembly.
Figure 3:
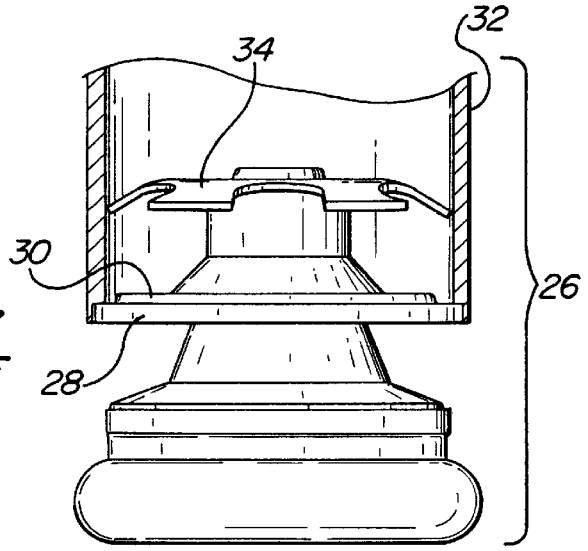
FIG-3 PRIOR ART
FIG. 3 is a cutaway side elevational view of the collarless glide assembly of FIG. 2.

Referring to FIG. 1, a chair 10 is shown which has hollow metal legs 12. Glide assemblies 14 are attached to the bottom of the hollow metal legs 12. While a chair 10 is shown, the present invention may also be used with other types of furniture having hollow legs. The invention is also not limited to metal legs and could instead be used with hollow plastic or wooden legs.

Referring now to FIG. 6, a glide assembly 40 including an attachment plate 42 according to the present invention is shown. The glide assembly 40 includes a glide base 44 which is designed to contact a floor surface. A pedestal 46 is positioned atop the glide base 44. In some embodiments, the pedestal 46 may include a silencer 48 which is made out of a material such as plastic or rubber. The pedestal 46 is positioned between the attachment plate 42 and the glide base 44. The attachment plate 42 is designed to be positioned in the end of a chair leg 50, which in this illustration is shown as a hollow metal tube. A clip 52, typically made of spring steel, is positioned above the attachment plate 42 and is designed to engage an inside wall 54 of the chair leg 50 thereby retaining the glide assembly 40 in the end of the chair leg 50. The clip 52, attachment plate 42, pedestal 46, and glide base 44 are all interconnected by a central pin 56.

Figure 7:
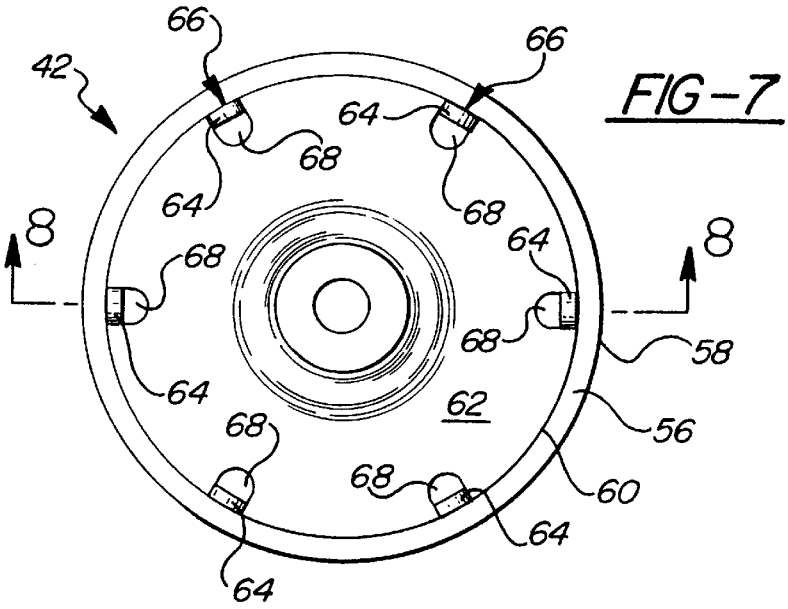
FIG. 7 is a top view of a glide attachment plate according to the present invention.
Figure 8:
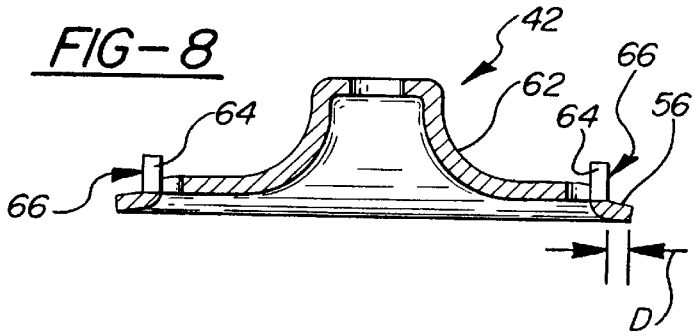
FIG. 8 is a cross sectional side view of the glide attachment plate of FIG. 7 taken along lines 8—8.

Referring now to FIGS. 7 and 8, the attachment plate 42 will be described in more detail. The attachment plate 42 has a perimeter portion 56 which extends from the exterior edge 58 of the plate 42 to an interior edge 60 which is spaced from the exterior edge 58 by a distance D. The perimeter portion 56 of the plate 42 is designed to mate with the solid portion of the cross section of the chair leg 50, which is a hollow tube. In the example of FIG. 7, the perimeter portion is a circular ring with a width equal to distance D. Preferably, the distance D is approximately equal to the thickness of the hollow tube forming the chair leg 50 so that the exterior edge 58 vertically aligns with the outside of the chair leg 50 and the interior edge 60 of the perimeter portion 56 is approximately vertically aligned with the inner wall 54 of the chair leg 50.

The remaining portion of the attachment plate 42, extending inboard from the interior edge 60 of the perimeter portion 56, is defined as the interior portion 62 of the attachment plate 42. The interior portion 62 includes a plurality of tabs 64 extending upwardly. Each of the tabs 64 has a gripping face 66 which is directed toward the perimeter portion 56 and is vertically aligned with the interior edge 60 of the perimeter portion 56. By vertically aligned, it is met that the gripping face 66 of the tabs 64 approximately corresponds with the interior edge 60 of the perimeter portion 56. However, it is not required that the gripping faces 66 be perpendicular to a plane containing the perimeter portion 56. Instead, the tab 64 may extend upwardly at a variety of angles depending on the design requirements for the particular attachment plate 42. Ultimately, it is intended that the gripping faces 66 of the tabs 64 engage the inner wall 54 of the chair leg 50 and are therefore positioned so as to generally line up with this inner wall 54.

As shown, the tabs 64 are preferably equally spaced around the circumference of the interior portion 62. The tabs 64 are configured to engage the inner wall 54 of the solid portion of the cross section of the hollow tube forming the chair leg 50. The tabs 64 act to stabilize the attachment plate 42 in the chair leg 50 and resist shear loads and twisting forces. As discussed earlier, it is best if a glide assembly is as inexpensive as possible. In accordance with this need, the attachment plate 42, as illustrated in FIGS. 7 and 8, may be formed by stamping it out of a piece of metal. Therefore, the tabs 64 preferably are upwardly bent out of the interior portion 62 of the attachment plate 42. The tabs 64 may be bent upwardly as part of the stamping operation or as part of a subsequent operation. By bending the tabs 64 upwardly out of the interior portion 62, small recesses 68 are left in the interior portion 62. Alternatively, the tabs 64 may be bent upwardly out of the perimeter portion 56 or may be entirely separate pieces attached to the interior portion 62.

To further enhance the stability of the attachment plate 42 in the chair leg 50, the interior portion 62 of the attachment plate 42 is preferably offset from the perimeter portion 56. That is, the perimeter portion 56 preferably resides in a first plane and at least part of the interior portion 62 resides in a second plane. The first and second planes are offset or separated such that a ridge is formed at the interior edge 60 of the perimeter portion 56. This acts to further stabilize the attachment plate 42 in the chair leg 50.

As best shown in FIGS. 6 and 8, the interior portion 62 of the attachment plate 42 has a central region which is generally bell shaped. This bell shaped center region rises upwardly away from the plane containing the perimeter portion 56. The pedestal 46 engages this bell shaped central portion when the glide assembly 40 is assembled. This acts to help center the pedestal 46 while allowing the pedestal 46 to pivot with respect to the attachment plate 42. As will be clear to one of skill in the art, other shapes are also possible without departing from the teachings of the present invention.

Figure 9:
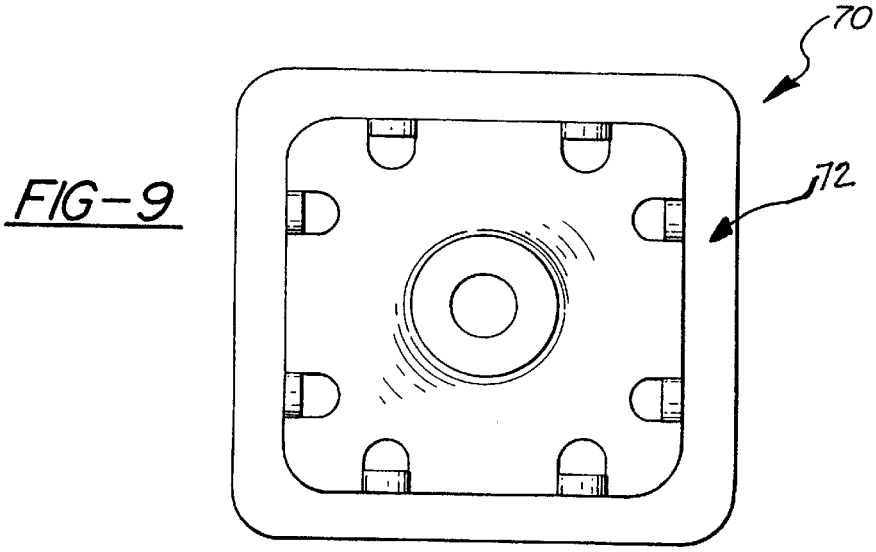
FIG. 9 is a top view of a second embodiment of a glide attachment plate according to the present invention.

Referring now to FIG. 9, a second embodiment of the attachment plate according to the present invention is generally shown at 70. In this embodiment, the attachment plate 70 has a square perimeter portion 72. This embodiment is designed for use with a chair leg having a generally square cross section. As will be clear to one of skill in the art, the shape of the perimeter portion of the attachment plate may be varied to work with other cross sectional shapes of chair legs.

The proceeding specification and figures disclose and discuss preferred embodiments of the present invention but should not be interpreted narrowly or as limitations on the practice of the present invention. Instead, as will be clear to one of skill in the art, variations may be made on the embodiments of the present invention previously discussed without departing from the intent or scope of the invention. It is the following claims, including all equivalents, which define the present invention.

What is claimed is:

1. A glide attachment plate for supporting a glide with respect to an end of a furniture leg, the end of the furniture leg being a hollow tube with an inner wall, said attachment plate comprising:

a perimeter portion extending inboard from an exterior edge of said plate to an interior edge spaced from said exterior edge by a distance D, said perimeter portion having a shape corresponding to the solid portion of a cross section of the hollow tube;

an interior portion extending inboard from said interior edge of said perimeter portion; and a plurality of tabs projecting upwardly from said interior portion, said tabs each having a gripping face directed toward said perimeter portion, said gripping faces being vertically aligned with said interior edge, said tabs being configured to engage the inner wall of the hollow tube.

2. The glide attachment plate according to claim 1, wherein said tabs are upwardly bent portions of said interior portion.

3. The glide attachment plate according to claim 1, wherein said perimeter portion resides in a first plane and at least a part of said interior portion resides in a second plane which is separated from said first plane.

4. The glide attachment plate according to claim 1, wherein said tabs are evenly spaced from one another.

5. The glide attachment plate according to claim 1, wherein said plurality of tabs comprises six tabs.

6. The glide attachment plate according to claim 1, wherein the cross sectional shape of the solid portion of the hollow tube is circular and said perimeter portion has a corresponding circular shape.

7. The glide attachment plate according to claim 1, wherein the cross sectional shape of the solid portion of the hollow tube is rectangular and said perimeter portion has a corresponding rectangular shape.

8. A glide assembly for terminating an end of a furniture leg, the end being a hollow tube with an inner wall, said glide assembly comprising:

a glide base configured for contacting a floor;

a pedestal supported on said glide base;

a glide attachment plate interconnected with said pedestal and configured to engage the end of the furniture leg, said attachment plate comprising a perimeter portion, an interior portion, and a plurality of tabs, said perimeter portion extending inboard from an exterior edge of said plate to an interior edge spaced from said exterior edge by a distance D, said perimeter portion having a shape corresponding to the solid portion of a cross section of the hollow tube, said interior portion extending inboard from said interior edge of said perimeter portion, and said plurality of tabs extending upwardly from said interior portion, said tabs each having a gripping face directed toward said perimeter portion, said gripping faces being vertically aligned with said interior edge, said tabs being configured to engage the inner wall of the hollow tube; and a retaining means for retaining said attachment plate in the hollow tube.

9. The glide assembly according to claim 8, wherein said tabs are upwardly bent portions of said interior portion of said attachment plate.

10. The glide assembly according to claim 8, wherein said perimeter portion of said attachment plate resides in a first plane and at least a part of said interior portion resides in a second plane which is separated from said first plane.

11. The glide assembly according to claim 8, wherein said tabs are evenly spaced from one another.

12. The glide assembly according to claim 8, wherein said plurality of tabs comprises six tabs.

13. The glide assembly according to claim 8, wherein the cross sectional shape of the solid portion of the hollow tube is circular and said perimeter portion of said attachment plate has a corresponding circular shape.

14. The glide assembly according to claim 8, wherein the cross sectional shape of the solid portion of the hollow tube is rectangular and said perimeter portion of said attachment plate has a corresponding rectangular shape.

* * * * *

UNITED STATES PATENT AND TRADEMARK OFFICE

CERTIFICATE OF CORRECTION

PATENT NO. : 6,088,877

DATED : Jul. 18, 2000

INVENTOR(S) : Philip P. Swy, et. al

It is certified that error appears in the above-identified patent and that said Letters Patent are hereby corrected as shown below:

Column 2, line 41 - Replace "fog" with --forming--

Column 2, line 46 - Replace "th" with --the--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*